US010697192B2

(12) United States Patent
Richard et al.

(10) Patent No.: US 10,697,192 B2
(45) Date of Patent: Jun. 30, 2020

(54) RETROFIT DESIGNS FOR STEEL BEAM-TO-COLUMN CONNECTIONS

(71) Applicant: Seismic Structural Design Associates, Inc., Peoria, AZ (US)

(72) Inventors: Ralph M. Richard, Tucson, AZ (US); Clayton J. Allen, Peoria, AZ (US)

(73) Assignee: SEISMIC STRUCTURAL DESIGN ASSOCIATES, Peoria, AZ (US)

( * ) Notice: Subject to any disclaimer, the term of this patent is extended or adjusted under 35 U.S.C. 154(b) by 0 days.

(21) Appl. No.: 16/397,868

(22) Filed: Apr. 29, 2019

(65) Prior Publication Data

US 2019/0330873 A1 Oct. 31, 2019

Related U.S. Application Data

(60) Provisional application No. 62/663,881, filed on Apr. 27, 2018, provisional application No. 62/727,797, filed on Sep. 6, 2018.

(51) Int. Cl.
*E04H 9/02* (2006.01)

(52) U.S. Cl.
CPC ..... *E04H 9/027* (2013.01); *E04H 9/024* (2013.01)

(58) Field of Classification Search
CPC ..... E04H 9/027; E04H 9/024
USPC ..... 52/741.3
See application file for complete search history.

(56) References Cited

U.S. PATENT DOCUMENTS 3,295,288 A * 1/1967 Bakke ..... E04B 1/2403 52/741.1
4,129,974 A * 12/1978 Ojalvo ..... E04C 3/06 29/897.35
4,771,705 A * 9/1988 Przybylinski ..... B61D 9/06 105/404
5,680,738 A * 10/1997 Allen ..... E04B 1/2403 52/837
6,237,303 B1 * 5/2001 Allen ..... E04B 1/2403 52/653.1
7,047,695 B2 * 5/2006 Allen ..... E04B 1/2403 52/120
7,278,365 B2 * 10/2007 Michalski ..... B23K 31/02 114/65 R (Continued)

OTHER PUBLICATIONS

FEMA 350 (2000) "Recommended Seismic Design Criteria for New Steel Moment Frame Buildings", Federal Emergency Management Agency, Washington D.C.

(Continued)

*Primary Examiner* — Jeanette E Chapman
(74) *Attorney, Agent, or Firm* — Kilpatrick Townsend & Stockton LLP

(57) ABSTRACT

A method of retrofitting a pre-Northridge type steel beam-to-column connection, includes welding the web of the beam to a flange of the column and slotting the beam web in the region of the connection and near the beam flanges. Stress relief holes are made into the web of the beam and slots are cut into the web of the beam. A top backup bar is welded to the flange of the column and a bottom backup bar is removed from the flange weld to the column. The method includes back gouging the flange of the column at a position of the removed backup bar and welding a bottom flange of the beam to the flange of the column.

13 Claims, 5 Drawing Sheets

(56) References Cited

U.S. PATENT DOCUMENTS 9,963,872 B2 * 5/2018 Hensley ..... E01C 11/14

OTHER PUBLICATIONS

Richard, R. M.,, Allen, C. J,, Partridge, J.E,. (1997) "Proprietary Slotted Beam Connection Designs", Modern Steel Construction, AISC, Mar. 1997.

Yu, Y.Y. (1959). "A New Theory of Elastic Sandwich Plates—One Dimensional Case", *Jr. of Applied Mechanics,* vol. 26, No. 3, pp. 415-423.

American Institute of Steel Construction, Inc. Manual of Steel Construction American Institute of Steel Construction, Inc. (1986) *Load and Resistance Factor Design Specifications for Structural Steel Buildings,* Chicago, IL.

Mahin, S., (2000). "Why it Happened", New Recommended Seismic Design Criteria for Steel MomentFrame Buildings: Speaker's Slides, SAC Regional Training Seminar, pp. 3.6-3.7.

Barsom, John M. (2000), Development of Fracture Toughness Requirements for Weld Materials in Seismic Applications, *SAC Steel Project—Task 7.1.3,* SAC Joint Venture, Richmond, CA. (abstract of).

* cited by examiner

RETROFIT DESIGNS FOR STEEL BEAM-TO-COLUMN CONNECTIONS

CROSS-REFERENCE TO RELATED APPLICATIONS

This application claims the benefit of U.S. Provisional Application No. 62/663,881, entitled "RETROFIT DESIGNS FOR STEEL BEAM-TO-COLUMN CONNECTIONS", filed on Apr. 27, 2018, and U.S. Provisional Application No. 62,727,797, entitled "RETROFIT DESIGNS FOR STEEL BEAM-TO-COLUMN CONNECTIONS", filed on Sep. 6, 2018, the entire contents of which are hereby incorporated by reference.

BACKGROUND OF THE INVENTION

Extensive research by structural engineers has shown that the flange-welded—web-bolted steel beam-to-column connection design methodology that is widely used in the construction of steel moment frames is flawed[1] and should not be used in the design of moment frames that are subject to seismic or large wind loads. This connection, shown in FIG. 1, which was used extensively prior to the 1994 Northridge, Calif. earthquake, has now become known as the pre-Northridge connection. The flaw in the design rationale is that it assumes that at the beam-to-column connection, the shear in the beam is totally resisted by the beam web and the moment in the beam is totally resisted by the beam flanges. However, research[2345] has shown that 50% or more of the shear is resisted by the beam flanges. Because of this, the moment and shear in the beam flanges result in large variations in the stress and strain distributions across and through the beam flanges and welds in the connection which compromise the strength and ductility of the connection. Embodiments of the invention provide solutions to these and other issues.

[1] FEMA 350 (2000) "Recommended Seismic Design Criteria for New Steel Moment Frame Buildings", Federal Emergency Management Agency, Washington D.C.

[2] Richard, R. M., Partridge, J. E., Allen, J, Radau, S. (1995) "Finite Element Analysis and Tests of Beam-to-Column Connections" Modern Steel Construction, AISC, October 1995, pp. 44-47.

[3] Richard, R. M., Allen, C. J., Partridge, J. E., (1997) "Proprietary Slotted Beam Connection Designs", Modern Steel Construction, AISC, March, 1997.

[4] Richard, R. M. and Radau, R. E. (1998). "Force, Stress, and Strain Distributions in FR Bolted-Welded Connections", *Proceedings of the '98 Structural Engineers World Congress*, Technical Paper T199-3.

[5] FEMA 350 (2000) Recommended Seismic Design Criteria For New Steel Moment Frame Buildings, Federal Emergency Management Agency, Washington D.C.

BRIEF SUMMARY OF THE INVENTION

Embodiments of the present invention relate to systems and methods for creating beam connections that provide improvements over and, where necessary, repair of pre-Northridge connections by eliminating the shear in the beam flanges, as well as the large stress and strain concentrations in the beam flanges. Specifically, embodiments of the invention provide techniques for creating beam connections that utilize particular arrangements of beam web slots and beam web welds to achieve these benefits. Using beam web slots and beam web welds as presented herein for existing pre-Northridge connections eliminates the shear in the beam flanges and eliminates the large stress and strain concentrations in the beam flanges. Embodiments of the invention provide methods for retrofitting existing pre-Northridge connections to utilize beam web slots and beam web welds.

In one embodiment, a slotted web beam connection is provided. The connection may include a column having a column flange, as well as a beam. The beam may include a first beam flange and a second beam flange. Each of the first beam flange and the second beam flange may be welded to the column flange. The beam may also include a beam web extending between the first beam flange and the second beam flange. The beam web may be welded to the column flange. The beam web may define one or more stress relief holes and one or more weld access holes. The beam web may further define a slot extending between and joining the one or more stress relief holes and a respective one of the one or more weld access holes. The connection may also include an upper backup bar that is welded to the column flange.

In another embodiment, a method of producing a slotted web beam connection is provided. The method may include welding a web of a beam to a flange of a column, welding a shear plate to the web of the beam such that an edge of the shear plate abuts the flange of the column and is welded to the column flange, and drilling stress relief holes into the web of the beam. The method may also include cutting slots into the web of the beam and welding a top backup bar to the flange of the column.

In another embodiment, a method of retrofitting a pre-Northridge steel beam-to-column connection is provided. The method may include welding a web of a beam to a flange of a column, drilling stress relief holes into the web of the beam, and cutting slots into the web of the beam. The method may also include welding a top backup bar to the flange of the column, removing a bottom backup bar from the flange of the column, and back gouging the beam flange weld to the column at a position of the removed backup bar. The method may further include welding a bottom flange of the beam to the flange of the column. The method may also include replacing or repairing existing beam-to-column welds.

BRIEF DESCRIPTION OF THE DRAWINGS

A further understanding of the nature and advantages of various embodiments may be realized by reference to the following figures.

DETAILED DESCRIPTION OF THE INVENTION

Figure 1:
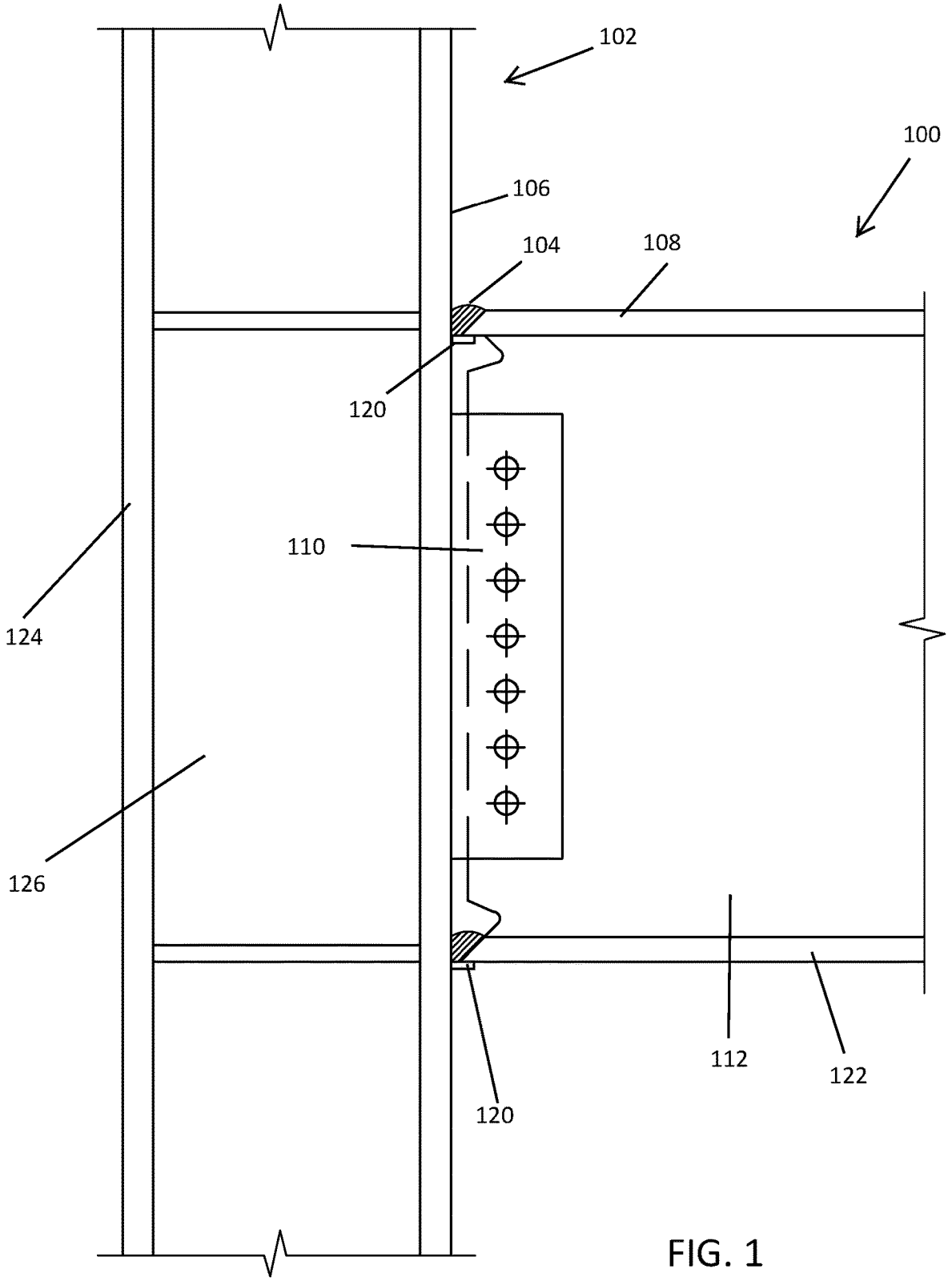
FIG. 1 PRIOR ART
FIG. 1 depicts an existing pre-Northridge moment connection.

The ensuing description provides exemplary embodiments only, and is not intended to limit the scope, applicability or configuration of the disclosure. Rather, the ensuing description of the embodiments will provide those skilled in the art with an enabling description for implementing multiple embodiments. It will be understood that various changes may be made in the function and arrangement of elements without departing from the spirit and scope of this disclosure.

As described above, the pre-Northridge connection that is commonly used in the construction of steel moment frames is flawed in that it relies upon an incorrect assumption that at the connection, the shear in the beam is totally resisted by the beam web and the moment in the beam is totally resisted by the beam flanges. Embodiments of the invention provide a slotted web retrofit design methodology that uses beam web slots to eliminate or reduce the beam flange moments and shears. This results in a near uniform stress and strain distribution in the beam flanges and in the beam-to-column welds. A beam web groove weldment is added to a column flange and uses a shear plate as a backing. The shear plate is secured to a beam web with an edge of the shear plate abutting the column flange. Such an arrangement provides both moment and shear resistance by the beam web.

Analytical studies[6,7,8] have shown that the shear distribution at the support of cantilever beams differs drastically from that predicted by classical Bernoulli-Euler beam theory that lead to the popular design concept wherein "the flanges carry the moment and the web carries the shear." It was shown that in the case of a rigid support (beam web and flanges welded to a rigid column flange), the entire beam shear is resisted by the flanges. For typical "Flange-Welded, Web-Bolted" connection designs[9] however, 50% or more of the shear is resisted by the beam flanges. Following the 1994 Northridge, Calif. earthquake, where numerous of these connections in steel moment frame buildings fractured, this connection is now called the pre-Northridge connection.[10,11] It is this large component of the beam flange shear in combination with the beam flange moment that causes severe stress and strain gradients across and through the beam flanges of these connections. Research[12,13] has shown the strain demands on the beam flanges and weld material is 8 times the yield strain for an unreinforced pre-Northridge connection and 5 times the yield strain for a Reduced Beam Section connection.[14]

[6] Yu, Y. Y. (1959). "A New Theory of Elastic Sandwich Plates—One Dimensional Case", *Jr. of Applied Mechanics*, Vol. 26, No. 3, pp. 415-423

[7] Abel, J. F. and Popov, E. P. (1968). "Static and Dynamic Finite Element Analysis of Sandwich Structures", Air Force Flight Dynamics Laboratory T. R. No. 68-150, pp. 213-245, Dayton, Ohio

[8] Richard, R. M. and Radau, R. E. (1998). "Force, Stress, and Strain Distributions in FR Bolted-Welded Connections", *Proceedings of the '98 Structural Engineers World Congress*, Technical Paper T199-3.

[9] American Institute of Steel Construction, Inc. Manual of Steel Construction American Institute of Steel Construction, Inc. (1986) *Load and Resistance Factor Design Specifications for Structural Steel Buildings*, Chicago, Ill.

[10] Mahin, S., (2000). "Why it Happened", New Recommended Seismic Design Criteria for Steel Moment-Frame Buildings: Speaker's Slides, SAC Regional Training Seminar, pp. 3.6-7.

[11] Malley, J., (2000). "Parameters Contributing to the Improved Performance", New Recommended Seismic Design Criteria for Steel Moment-Frame Buildings: Speaker's Slides, SAC Regional Training Seminar, p. 5-19.

[12] Barson, John M. (2000), Development of Fracture Toughness Requirements for Weld Materials in Seismic Applications, *SAC Steel Project—Task* 7.1.3, SAC Joint Venture, Richmond, Calif.

[13] Fry, G. T., et al., (2000), Supplemental Analysis and Testing of Reduced Beam Section Components, *SAC Steel Project—Task* 7.0.6, SAC Joint Venture, Richmond, Calif.

[14] FEMA 350 (2000) Recommended Seismic Design Criteria For New Steel Moment Frame Buildings, Federal Emergency Management Agency, Washington D.C.

A pre-Northridge connection is shown in FIG. 1. For example, a beam 100 is shown mounted on a column 102 using a pre-Northridge connection configuration. Beam 100 is an I-beam having a top flange 108 and a bottom flange 122. A beam web 112 extends between and connects the top flange 108 and the bottom flange 122. Similarly, column 102 includes a first flange 106 and a second flange 124, as well as a column web 126 that extends between and connects the first flange 106 and the second flange 124. To form the pre-Northridge connection, a groove weld 104 is formed between a flange 106 of the column 102 and the top flange 108 of the beam 100. A shear plate 110 is bolted to the beam web 112 such that a vertical edge of the shear plate abuts the first flange 106 of the column 102 and is coupled to the first flange 106 of the column 102. Backup bars 120 may be positioned against an underside of the top flange 108 and bottom flange 108 of the beam 100. As discussed above, in connections of this type, 50% or more of the shear is resisted by the beam flanges. Because of this, the moment and shear in the beam flanges result in large variations in the stress and strain distributions across and through the beam flanges and welds in the connection which compromise the strength and ductility of the connection. Embodiments of the present invention utilize beam web slots and beam web welds on existing pre-Northridge connections to eliminate the shear in the beam flanges and to eliminate the large stress and strain concentrations in the beam flanges.

Figure 2:
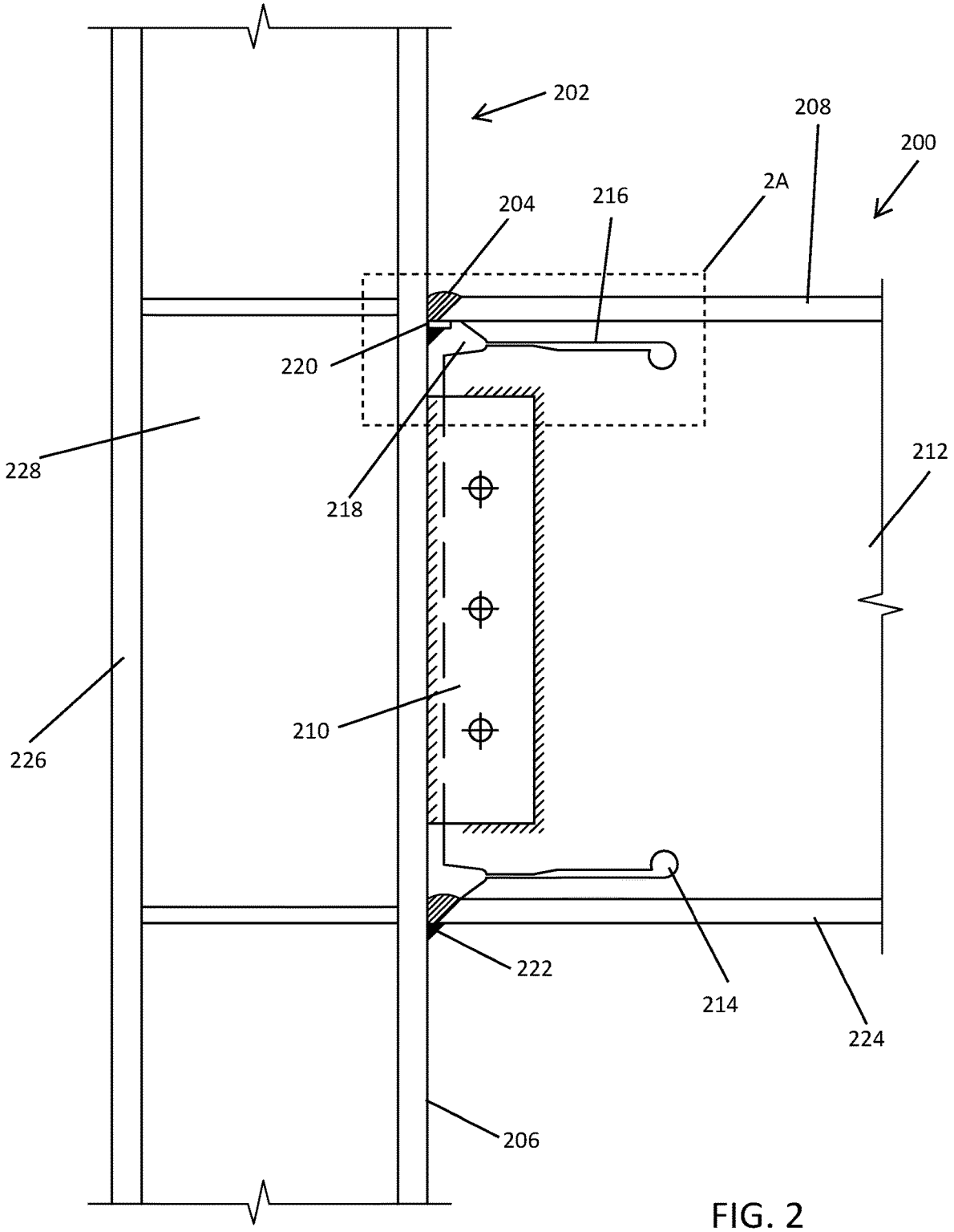
FIG. 2 depicts a slotted web connection in accordance with the present invention.
Figure 2A:
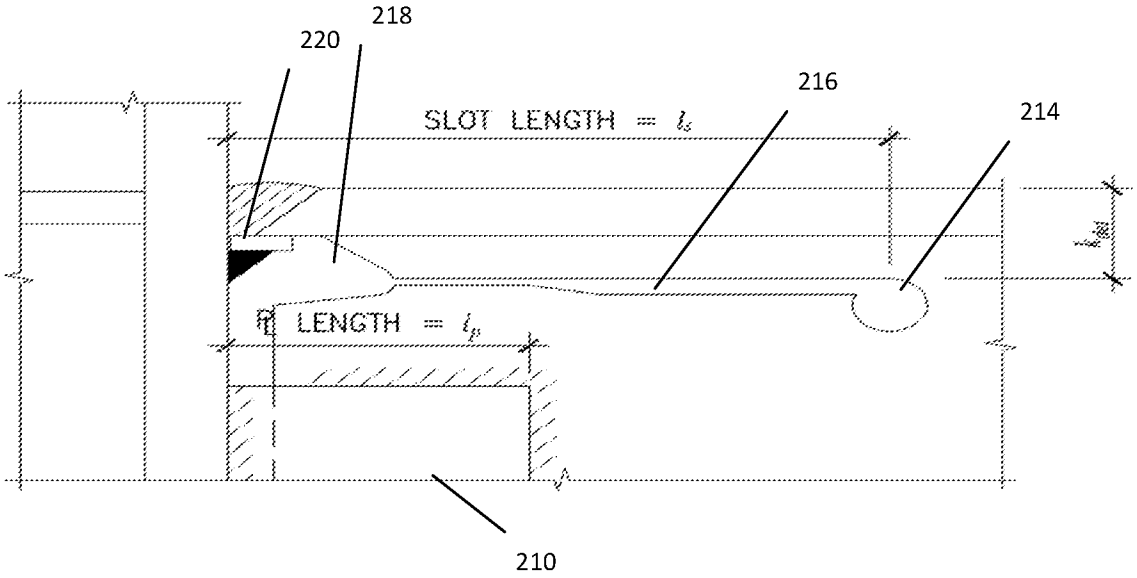
FIG. 2A depicts the slotted web connection of FIG. 2 in accordance with the present invention.

One embodiment of a slotted web connection in accordance with the present invention is shown in FIGS. 2 and 2A. The slotted web connection may be formed by retrofitting a pre-Northridge moment connection, such as described in relation to FIG. 1 above. In other embodiments, the slotted web connection may be formed during initial construction of the connection. A beam 200 may be an I-beam having a top flange 208 and a bottom flange 224. A beam web 212 extends between and connects the top flange 208 and the bottom flange 224. Similarly, column 202 includes a first flange 206 and a second flange 226, as well as a column web 228 that extends between and connects the first flange 206 and the second flange 226. Here, the beam 200 is shown with the beam web 212 being welded to the first flange 206 of column 202. For example, the web 212 may be groove welded to the first flange 206 of the column 202. Each of the top flange 208 and the bottom flange 224 of the beam 200 have groove welds 204 formed between the respective flange 208, 224 and the first flange 206 of column 202. For example, the groove welds may be formed in outer surfaces of the beam flanges 208, 224. The top flange 208 may have a groove weld applied to secure the top flange 208 to the first flange 206 of the column 202. The bottom flange 224 may have a groove weld applied to secure the bottom flange 224 to the first flange 206 of the column 202. A shear plate 210 may optionally be welded to the beam web 212, depending on the design of the shear plate 210. For example, if the shear plate thickness is equal to or greater than ⅔ of the beam web thickness and has existing supplemental welds then the shear plate may be welded to the beam web. If the connection of the beam web 212 to the column flange 206 of the existing column 202 is a bolted connection, remove the bolted connection and replace the bolted connection with a welded shear plate connection. In some embodiments this may be done by fillet welding the shear plate 210 to the web 212. Stress relief holes 214 may be cut into the web 212. Slots 216 may be cut, such as by using thermal cutting or other beam cutting techniques, into the web 212 and may extend between the stress relief holes 214 and weld access holes 218. Each of the slots is formed adjacent to a nearest one of the beam flanges 208. The length of slots 216 may be driven by a relationship of $l_s \leq l_p + l_b/10$ based upon the web hinge length or about $l_s \leq d_{beam}/2$, where is $l_s$ the length of the slot, $l_p$ is the width of shear plate 210, and $l_b$ is the clear span/2. Other criterion for the slot length, $l_s$, may be approximately 1.50× (beam flange width) or approximately 14× (beam flange thickness).

An upper backup bar 220 is welded to the column flange 206, such as by using a fillet weld between a bottom of the backup bar 220 and the column flange 206. In retrofit applications, an existing lower backup bar (not shown) is removed, and any existing weld is back gouged and replaced using a fillet weld 222, such as a 5/16 inch fillet weld. By separating the beam flanges 208 from the beam web 212 with slots 216 and using fillet weld 222 to secure the beam web 212 to the column flange 206, the force distributions are changed from those in the pre-Northridge connection. Specifically, (1) the large component of the beam shear in the flanges 208, 224 is eliminated, (2) the large stress and strain gradients across and though the beam flanges 208, 224 are eliminated, and (3) the beam web connection to the column 202 and shear plate 210 resists substantially all of the beam shear.

ATC-24 protocol tests[15] have been made using the single-cantilever type and bare steel specimens as shown in test results in Table 1 below.

[15] Applied Technology Council, (1992). *Guidelines for Cyclic Seismic Testing of Components of Steel Structures*, pp. 13 and 35-36, Stanford, Calif.

TABLE 1

ATC-24 TESTS AND SUMMARY OF RESULTS

| TEST Nos. | BEAM COLUMN | INTERSTORY DRIFT (%) (Qualifying Drift = 4%) |
|---|---|---|
| 17 | 33 × 141 | 4.2 |
| 18 | 14 × 283 | 5.1 |
| 19 | 27 × 94 | 4.3 |
| 20 | 14 × 176 | 5.0 |
| 21 | 36 × 300 | 4.5 |
| 22 | 14 × 500 | 4.4 |
| 23 | 24 × 94 | 4.1 |
| 24 | 30 × 135 | 4.1 |
| 25 | 36 × 170 | 4.0 |
| 26 | 30 × 235 | 4.0 |
| 1a | 36 × 256 | 4.9 |
| | 27 × 307 | |
| 2a | u | 5.1 |
| 3a | 14 × 550 – (Gr. 65) | 6.0 |

This pseudo-static test with the loading protocol developed by in the FEMA/SAC program has been adopted in the AISC *Seismic Provisions* (AISC, 2016a). These tests, along with the finite element analysis of the slotted web connection, show that the yielding region is concentrated in the separated portion of the beam flanges and in the beam web at the end of the shear plate. Peak strengths of the test specimens are usually achieved at an interstory drift angle of approximately 0.03 and 0.04 radian. Reduction in strength, if any, is gradual and due to the out-of-plane buckling of both the beam flanges and web. Buckling of the flanges and web occurs concurrently but independently, which eliminates the lateral torsional mode of buckling. Review of the test data indicates that the slotted web connection, when designed and constructed in accordance with the limits and procedures presented herein, have developed interstory drift angles of 0.04 radian and 0.03 radian of plastic rotation or more under cyclic loading on a consistent basis. Ultimate failure typically occurs at drift angles of 0.05 to 0.07 radian by low cycle fatigue fracture of the flange near the end of the slot or partial fracture of the beam web/shear plate weldment to the column flange[16].

[16] Richard, et al., 2001.

Figure 3:
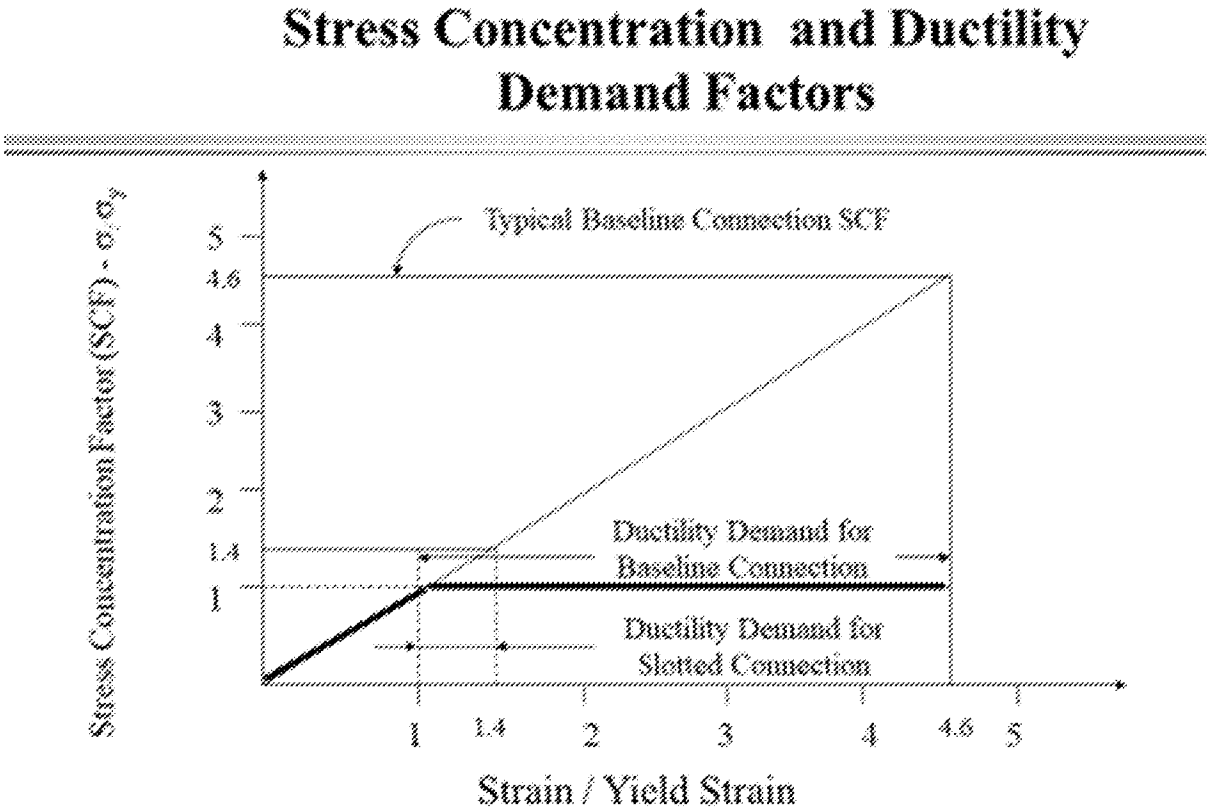
FIG. 3 is a graph showing the stress concentration and ductility demand factors of a baseline connection versus a slotted web connection according to embodiments of the present invention.

FIG. 3 is a chart depicting the stress concentration and ductility demand factors for a baseline (pre-Northridge) connection versus a slotted web connection in accordance with the invention. As shown here, the range of ductility demand for a slotted web connection (between about 1 and 1.4) is much smaller than a range for a baseline connection (between about 4.6 and 8) because, the stress concentration is much lower and confined to a smaller range for a slotted web connection.

Figure 4:
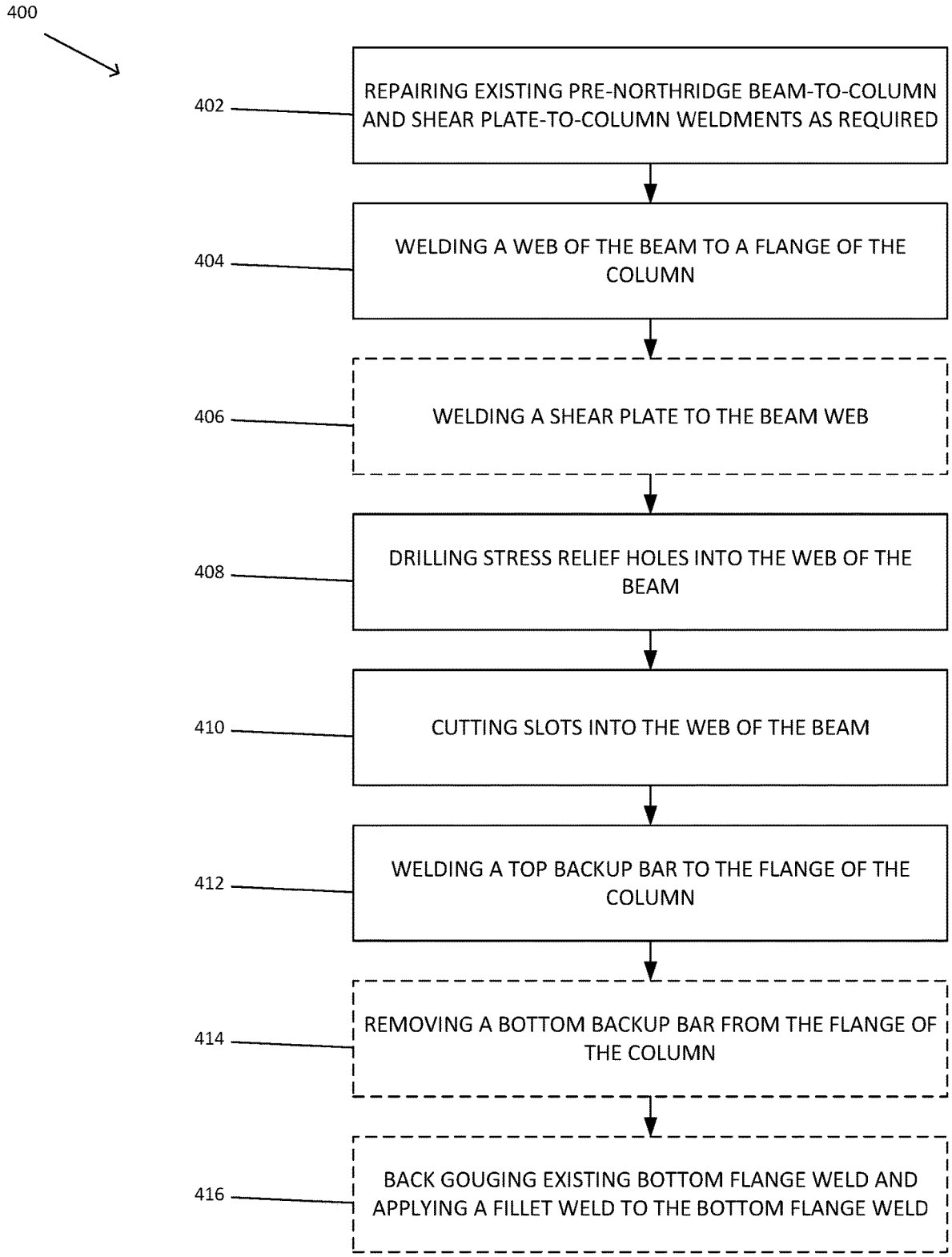
FIG. 4 is a flowchart depicting a process for forming a slotted web seismic moment frame connection in accordance with the present invention.

FIG. 4 depicts a process 400 of forming a slotted web seismic moment frame connection according to embodiments of the present invention. Process 400 may be used to form the slotted web connections described in relation to FIGS. 2 and 2A, above. Process 400 may be part of a retrofit procedure for replacing a pre-Northridge type connection with a slotted web connection of the present invention. Process 400 may be used to couple a beam having two flanges separated by a web with a column that also includes two flanges that are separated by a web. For retrofit applications, process 400 may optionally begin at block 402 by repairing existing pre-Northridge beam-to-column and shear plate-to-column weldments as required. As shown in block 404, the beam web may be welded to one of the column flanges. In some embodiments, this may be done using a groove weld. In some retrofit applications, the process 400 may involve lightening the load on the beam by removing the live loads prior to welding the beam web to the column flange. In some embodiments, a shear plate may be welded to the beam web as shown in block 406, such as by using a fillet weld. Whether this step is performed may be based on the design of the shear plate. For example, in retrofit applications, if an existing shear plate has a thickness is equal to or greater than ⅔ of a thickness of the beam web and has existing supplemental welds then the existing shear plate may be welded to the beam web.

At block 408, stress relief holes may be drilled in the beam web. At block 410, slots may be cut into the beam web, such as by using a thermal cutting device. The top backup bar may be welded to the column flange, such as by using a fillet weld, as shown in block 412. In some retrofit applications, an existing bottom flange backup bar may be removed as shown in block 414. Upon removing the existing backup bar, any existing weld may be back gouged and replaced using a fillet weld, such as a 5/16 inch fillet weld as shown in block 416.

Each flange of the beam may be welded to the column flange, such as by using groove welds formed between the respective flanges. In retrofit applications in which a pre-Northridge connection is being modified, the beam flanges will already be welded to the column flange. In new connections, process 400 may include welding the beam flanges to the column flange.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

The methods, systems, devices, graphs, and tables discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims. Additionally, the techniques discussed herein may provide differing results with different types of context awareness classifiers.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein. As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. A method of retrofitting a pre-Northridge type steel beam-to-column connection, comprising:

lightening a load on a beam by removing a live load on the beam, wherein the beam comprises:

a top beam flange and a bottom beam flange; and a beam web extending between the top beam flange and the bottom beam flange;

welding the beam web to a flange of a column;

drilling stress relief holes into the beam web;

cutting slots into the beam web;

welding a top backup bar to the flange of the column;

removing an existing bottom backup bar from the flange of the column;

back gouging an existing beam flange weld to the column at a position of the removed existing backup bar; and welding the bottom beam flange to the flange of the column.

2. The method of retrofitting a pre-Northridge type steel beam-to-column connection of claim 1, wherein:

the beam web is groove welded to the column flange.

3. The method of retrofitting a pre-Northridge type steel beam-to-column connection of claim 1, wherein:

each of the top beam flange and the bottom beam flange is groove welded to the column flange.

4. The method of retrofitting a pre-Northridge type steel beam-to-column connection of claim 1, further comprising:

welding a shear plate to the beam web upon welding the beam web to the flange of the column.

5. The method of retrofitting a pre-Northridge type steel beam-to-column connection of claim 4, wherein:

the shear plate is fillet welded to the beam web.

6. The method of retrofitting a pre-Northridge type steel beam-to-column connection of claim 1, wherein:

a length of each slot is approximately equal to one or more of 1.5×a width of the top beam flange or the bottom beam flange, 14×a thickness of the top beam flange or the bottom beam flange, or 0.5×a depth of the beam.

7. The method of retrofitting a pre-Northridge type steel beam-to-column connection of claim 1, wherein:

a length of each slot is driven by a relationship of $l_s \leq l_p + l_b/10$ based upon a web hinge length, where $l_s$ is the length of the slot, $l_p$ is a width of a shear plate, and $l_b$ is a clear span/2.

8. A method of retrofitting a pre-Northridge type steel beam-to-column connection, comprising:

welding a web of a beam to a flange of a column;

drilling stress relief holes into the web of the beam;

cutting slots into the web of the beam;

welding a top backup bar to the flange of the column;

removing a bottom backup bar from the flange of the column;

back gouging the beam weld to the column at a position of the removed bottom backup bar; and welding a bottom flange of the beam to the flange of the column.

9. The method of retrofitting a pre-Northridge steel beam-to-column connection of claim 8, comprising:

lightening a load on the beam by removing a live load on the beam prior to welding the web of the beam to the flange of the column.

10. The method of retrofitting a pre-Northridge type steel beam-to-column connection of claim 8, further comprising:

welding a shear plate to the web of the beam upon welding the web of the beam to the flange of the column.

11. The method of retrofitting a pre-Northridge type steel beam-to-column connection of claim 10, wherein:

the shear plate is fillet welded to the beam web.

12. The method of retrofitting a pre-Northridge type steel beam-to-column connection of claim 8, wherein:

a thickness of each of the slots is less than a diameter of each of the stress relief holes.

13. The method of retrofitting a pre-Northridge type steel beam-to-column connection of claim 8, wherein:

a length of each slot is driven by a relationship of $l_s \leq l_p + l_b/10$ based upon a web hinge length, where $l_s$ is the length of the slot, $l_p$ is a width of a shear plate, and $l_b$ is a clear span/2.

* * * * *